US009388995B2

(12) United States Patent
Lee et al.

(10) Patent No.: US 9,388,995 B2
(45) Date of Patent: Jul. 12, 2016

(54) INTERIOR ZONE PRESSURIZATION METHOD AND SYSTEM TO REDUCE THE STACK EFFECT PROBLEMS

(75) Inventors: Joong-Hoon Lee, Seoul (KR); Doo-Sam Song, Gyeonggi-do (KR)

(73) Assignee: Samsung C & T Corporation (KR)

( * ) Notice: Subject to any disclaimer, the term of this patent is extended or adjusted under 35 U.S.C. 154(b) by 1150 days.

(21) Appl. No.: 12/452,478

(22) PCT Filed: Aug. 19, 2008

(86) PCT No.: PCT/KR2008/004798

§ 371 (c)(1),
(2), (4) Date: Jan. 4, 2010

(87) PCT Pub. No.: WO2010/002063

PCT Pub. Date: Jan. 7, 2010

(65) Prior Publication Data

US 2010/0130118 A1 May 27, 2010

(30) Foreign Application Priority Data

Jul. 1, 2008 (KR) ..... 10-2008-0063629

(51) Int. Cl.
*F24F 7/00* (2006.01)
*F24F 7/10* (2006.01)
*F24F 11/00* (2006.01)

(52) U.S. Cl.
CPC ..... *F24F 7/10* (2013.01); *F24F 2011/0002* (2013.01)

(58) Field of Classification Search
CPC ..... F24F 7/00
USPC ..... 454/195, 68
See application file for complete search history.

(56) References Cited

U.S. PATENT DOCUMENTS 3,817,161 A * 6/1974 Koplon ..... 454/342
5,718,627 A * 2/1998 Wicks ..... 454/68

(Continued)

FOREIGN PATENT DOCUMENTS

JP 04-213579 A 8/1992
JP 09-152155 A 6/1997

(Continued)

OTHER PUBLICATIONS

"International Application Serial No. PCT/KR2008/004798, International Preliminary Report on Patentability dated Jan. 5, 2011", 5 pgs.

(Continued)

*Primary Examiner* — Steven B McAllister
*Assistant Examiner* — Samantha Miller
(74) *Attorney, Agent, or Firm* — Schwegman Lundberg & Woessner, P.A.

(57) ABSTRACT

A method and system for minimizing an incomplete closing phenomenon between an elevator hole and an interior section and a stack effect problem such as strong wind generated when opening an elevator door, which are inevitably generated at upper floors of high-rise office buildings, are provided. The method includes determining a degree of pressurization of the interior section in accordance with target pressure resistance and reduction in passing wind when opening the elevator door, and calculating a supply air volume required for the pressurization and an exhaust air volume from an elevator shaft based on the determined degree of the pressurization.

5 Claims, 3 Drawing Sheets

(56) References Cited

U.S. PATENT DOCUMENTS

| | | | | | |
|---|---|---|---|---|---|
| 5,979,607 | A * | 11/1999 | Allen | 187/390 |
| 7,059,958 | B2 * | 6/2006 | Santos | 454/68 |
| 2008/0207106 | A1 * | 8/2008 | Sekimoto | 454/68 |
| 2008/0274684 | A1 | 11/2008 | Peng et al. | |
| 2009/0050416 | A1 * | 2/2009 | Rotboll | 187/313 |

FOREIGN PATENT DOCUMENTS

| | | | | | |
|---|---|---|---|---|---|
| JP | 09-196445 | A | | 7/1997 | |
| JP | 2003-155788 | A | | 5/2003 | |
| JP | 2003155788 | A | * | 5/2003 | |
| JP | 2004-138252 | A | | 5/2004 | |
| JP | 2005-009840 | A | | 1/2005 | |
| JP | 2005-090885 | A | | 4/2005 | |
| JP | 2005119882 | A | * | 5/2005 | B66B 1/14 |
| JP | 2006-077540 | A | | 3/2006 | |
| JP | 2008-508163 | A | | 3/2008 | |
| KR | 86-001317 | B1 | | 9/1986 | |
| KR | 10-2003-0080422 | A | | 10/2003 | |
| KR | 10-0556676 | B1 | | 2/2006 | |
| WO | WO-2006/022844 | A1 | | 3/2006 | |
| WO | WO2006/074563 | | * | 7/2006 | |
| WO | WO-2007/075168 | A1 | | 7/2007 | |

OTHER PUBLICATIONS

"International Application Serial No. PCT/KR2008/004798, International Search Report mailed Mar. 27, 2009", 3 pgs.
"International Application Serial No. PCT/KR2008/004798, Written Opinion mailed Mar. 27, 2009", 4 pgs.
"Japanese Application Serial No. 2010-519161, Notice of Allowance dated Aug. 28, 2012", 2 pgs.

* cited by examiner

INTERIOR ZONE PRESSURIZATION METHOD AND SYSTEM TO REDUCE THE STACK EFFECT PROBLEMS

CROSS REFERENCE TO RELATED APPLICATION

This application is a nationalization under 35 U.S.C. 371 of PCT/KR2008/004798, filed on Aug. 18, 2008 and published as WO 2010/002063 A1 on Jan. 7, 2010, which application claims priority to and the benefit of Korean Patent Application No. 10-2008-0063629, filed on Jul. 1, 2008, which applications and publication are incorporated herein by reference and made a part hereof.

TECHNICAL FIELD

The present invention relates to a method for lessening a stack effect problem generated at upper floors of a skyscraper. More particularly, the present invention relates to a method and system for minimizing an incomplete closing phenomenon between an elevator hole and an interior section and a stack effect problem such as strong wind generated when opening an elevator door, which are inevitably generated at upper floors of high-rise office buildings, by reducing pressure applied to the elevator door and dividing door by fixing a natural zone and pressurizing the interior section.

BACKGROUND ART

Generally, the degree of a stack effect generated at upper floors of high-rise buildings is determined by not only a temperature difference between interior and exterior zones of the buildings, but also by the height of the building. That is, the degree of stack effect increases as the temperature difference between the interior and exterior zones of the buildings and the height of the building increase.

With more modern buildings becoming skyscrapers, various problems caused by the stack effect become more serious. Due to these problems, after the building is completed, additional work is required. This causes an increase in construction cost.

By the stack effect, a variety of doors such as elevator doors and entrance doors cannot be easily opened or they malfunction. In addition, a heat source load increases and warm agreeable surroundings are deteriorated due to infiltration and leakage of air. Furthermore, a weakness in disaster prevention increases and pollution spreads in the buildings.

The stack effect problems occur mainly when the pressure difference caused by the stack effect is concentrated at a specific local area of the building and when the sealing performance between sections of the building is low.

For a conventional high-rise building, the air leakage area of a dividing door dividing the interior section and the elevator hall is relatively small by plan characteristics of the building as compared with other sections, so the stack effect and pressure act in the building.

Accordingly, in the winter season, a dividing door that is opened toward the interior section is not completely closed at the upper floors of the high-rise building but maintains an open state. That is, the dividing door cannot function as a section divider. Therefore, when the elevator door is open, wind velocity passing through an unclosed space of the door significantly increases.

In order to solve the above problem, a construction plan such as distribution of action pressure by adding an additional section or adjustment of a door closer for the dividing door has been used to completely close the dividing door. However, when considering the use of the building and the intensity of the acting pressure, it is difficult to expect to get a feasible solution.

In addition, alternatives such as a pressurizing method and a pressure reducing method that use equipment have been considered. However, the conventional method in which the pressure characteristics of the section where the pressurizing and pressure reducing are practiced are not considered inevitably encounters secondary problems. For example, when the pressurizing is practiced for a section (pressurizing section), the pressure difference between the pressurizing section and an air inlet side section is reduced and thus the amount of air introduced is reduced. However, the pressure difference between the pressurizing section and an air outlet side section increases and thus the amount of discharged air increases. This may worsen the problems or cause other problems.

The above information disclosed in this Background section is only for enhancement of understanding of the background of the invention and therefore it may contain information that does not form the prior art that is already known in this country to a person of ordinary skill in the art.

DETAILED DESCRIPTION

Technical Problem

The present invention has been made in an effort to provide a method and system having an advantage of minimizing an incomplete closing phenomenon between an elevator hole and an interior zone and a stack effect problem such as strong wind generated when opening an elevator door, which are inevitably generated at upper floors of high-rise office buildings, by reducing pressure applied to the elevator door and dividing door by fixing a natural zone and pressurizing the indoor space.

The present invention also provides a method and system for lessening a stack effect problem, which determine sections to be pressurized considering a pressure difference and an amount of air flowing between the section to be pressurized and an adjacent section.

Technical Solution

An exemplary embodiment of the present invention provides an interior zone pressurizing method for lessening a stack effect problem, the method including: checking pressure resistance performance of a dividing door for dividing an elevator hall and an interior section of the building and setting a passing wind velocity by measuring the passing wind velocity when the elevator door is opened; calculating a pressurizing degree of the interior section of the floor to be pressurized based on the checked pressure resistance and the passing wind velocity; calculating a supply air volume required for the pressurization and an exhaust air volume from the elevator shaft to an outdoor side based on the degree of pressurization of the interior section; and pressurizing the interior section based on the supply air volume required for pressurizing the interior section and the exhaust air volume from the elevator shaft to the outdoor side while fixing a neutral zone.

Another exemplary embodiment of the present invention provides an interior zone pressurizing system for lessening a stack effect problem, the system including:

an indoor air supply unit including a duct unit to supply external air to an interior section of a floor to be pressurized in a building;

an elevator shaft exhaust air volume including a duct unit to exhaust air from an elevator shaft of a building to an outdoor side of the building;

supply/exhaust air volume sensors for measuring the supply air volume of the indoor air supply unit and the exhaust air volume of the elevator shaft;

absolute pressure sensors that are installed in the elevator shaft, interior section, and outdoor side to measure absolute pressures of the elevator shaft, interior section, and outdoor side;

an automatic control unit for pressurizing the interior section up to a preset level by calculating a pressure difference between the interior section of the floor to be pressurized and for controlling operation of the indoor air supply unit and elevator shaft air exhaust unit such that a neutral zone is not moved by calculating a pressure difference between an interior section of a floor not to be pressurized and the elevator shaft using measured values from the supply air volume sensor and the absolute pressure sensors;

a supply air temperature control unit that is installed in the indoor air supply unit to pre-heat the outdoor air supplied to the interior section of the floor to be pressurized;

a damper for preventing the air from flowing through the indoor air supply unit and the elevator shaft air exhaust unit when the system is not being operated; and an outdoor air temperature sensor that is designed to transfer measured data to the automatic control unit, that determines a temperature of the outdoor air to adjust operation conditions of the indoor air supply unit and the elevator shaft air exhaust unit, and that adjusts a pre-heat load of the supply air temperature control unit.

Advantageous Effects

According to the exemplary embodiments, it becomes possible to pressurize the interior section while fixing the neutral zone. Therefore, the secondary problems caused by the pressurization of the interior section can be prevented. In addition, it becomes possible to lessen the pressure acting on the elevator door and dividing door. Furthermore, it is also possible to minimize an incomplete closing phenomenon between an elevator hole and an interior section and a stack effect problem such as a strong wind generated when opening an elevator door, which are inevitably generated at upper floors of high-rise office buildings.

BEST MODE

Exemplary embodiments of the present invention will hereinafter be described in detail with reference to the accompanying drawings. In an exemplary embodiment, the case where some floors of a high-rise building are pressurized will be described.

Figure 1A:
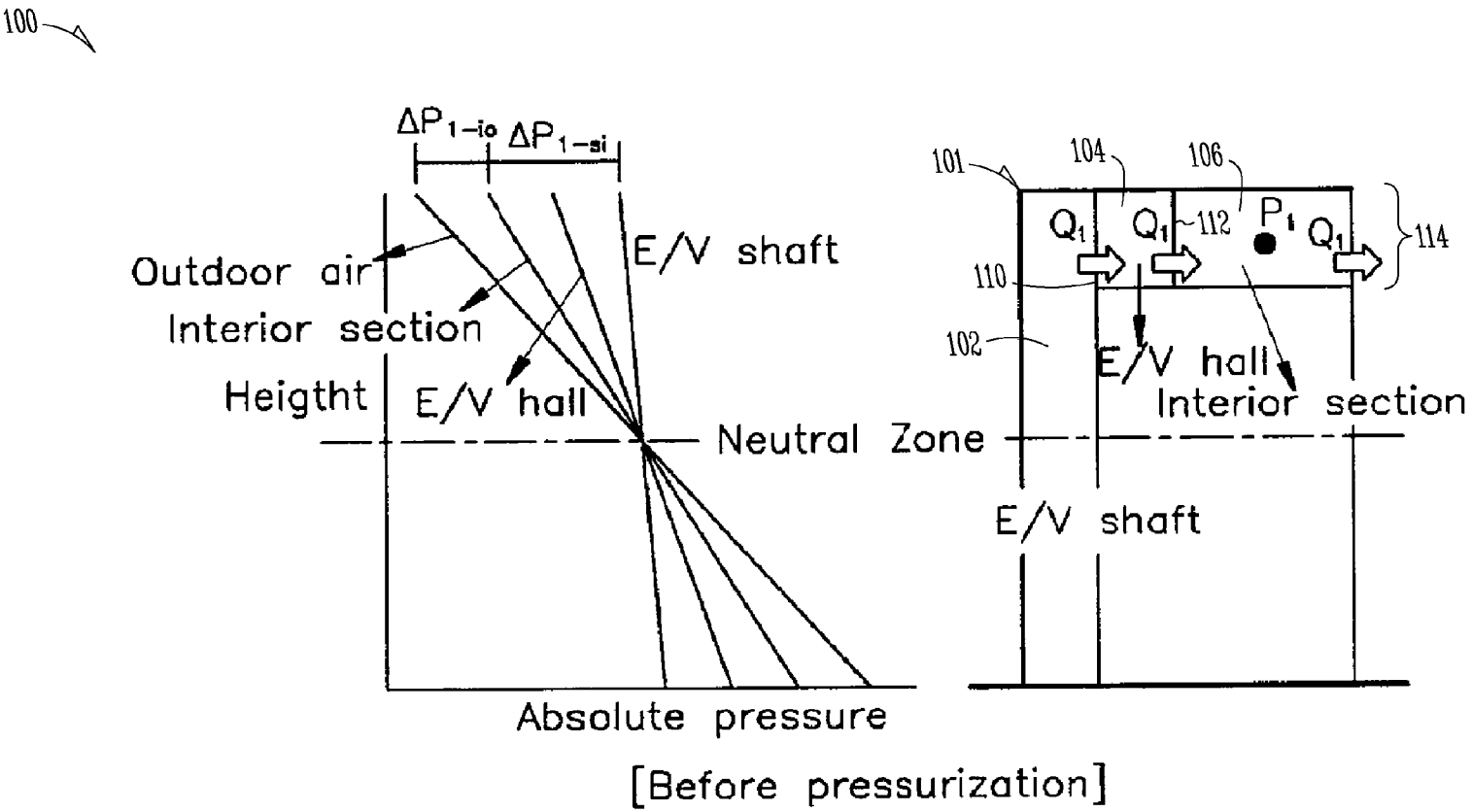
FIG. 1A and FIG. 1B (hereinafter collectively referred to as FIG. 1) represent a schematic view (100) showing distribution of outdoor air and interior vertical pressure and a concept of a pressure control for illustrating a method and system for pressurizing an interior office section (106) of a high-rise building (101) according to an exemplary embodiment of the present invention.
Figure 1B:
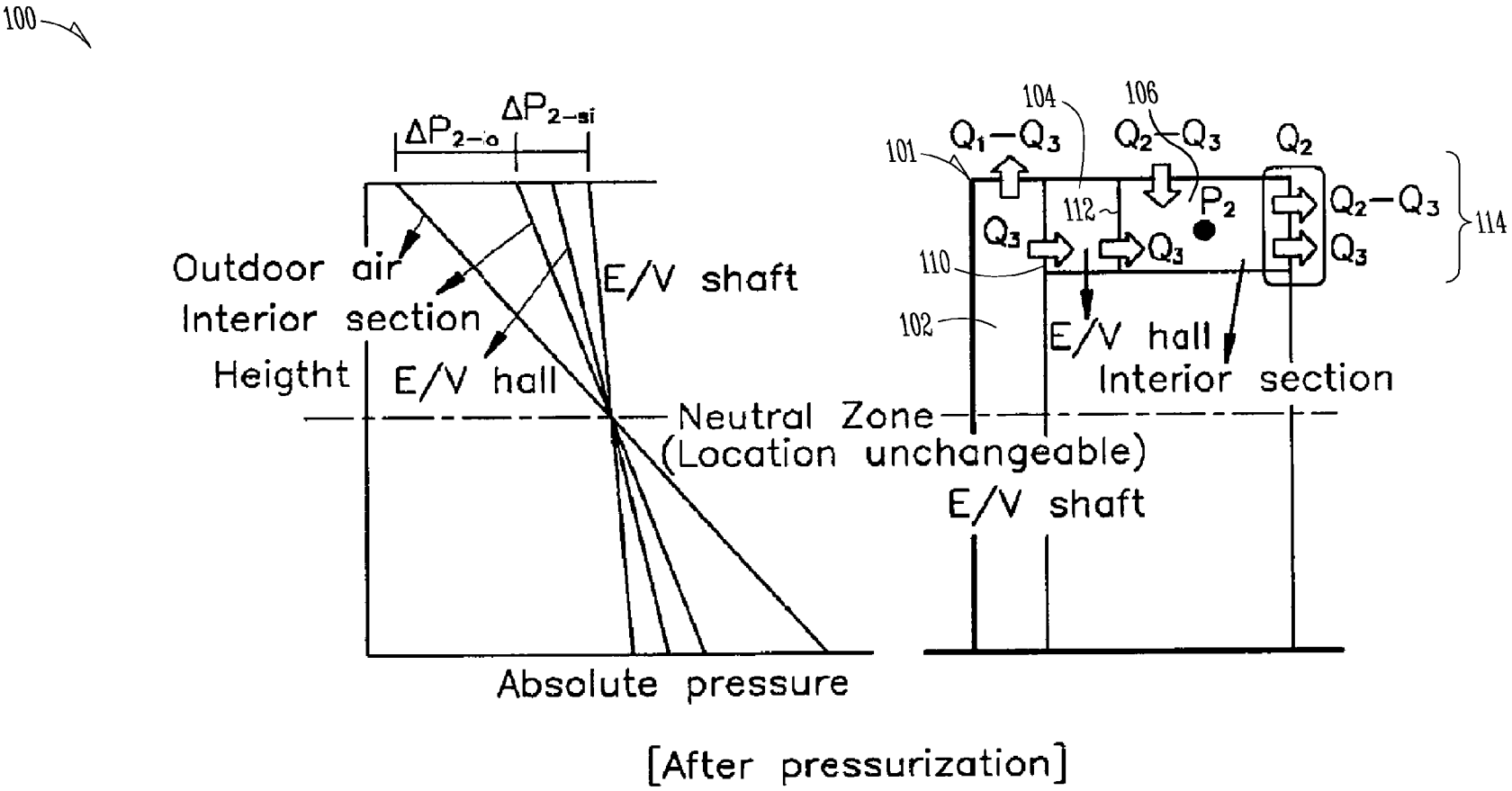
Figure 2:
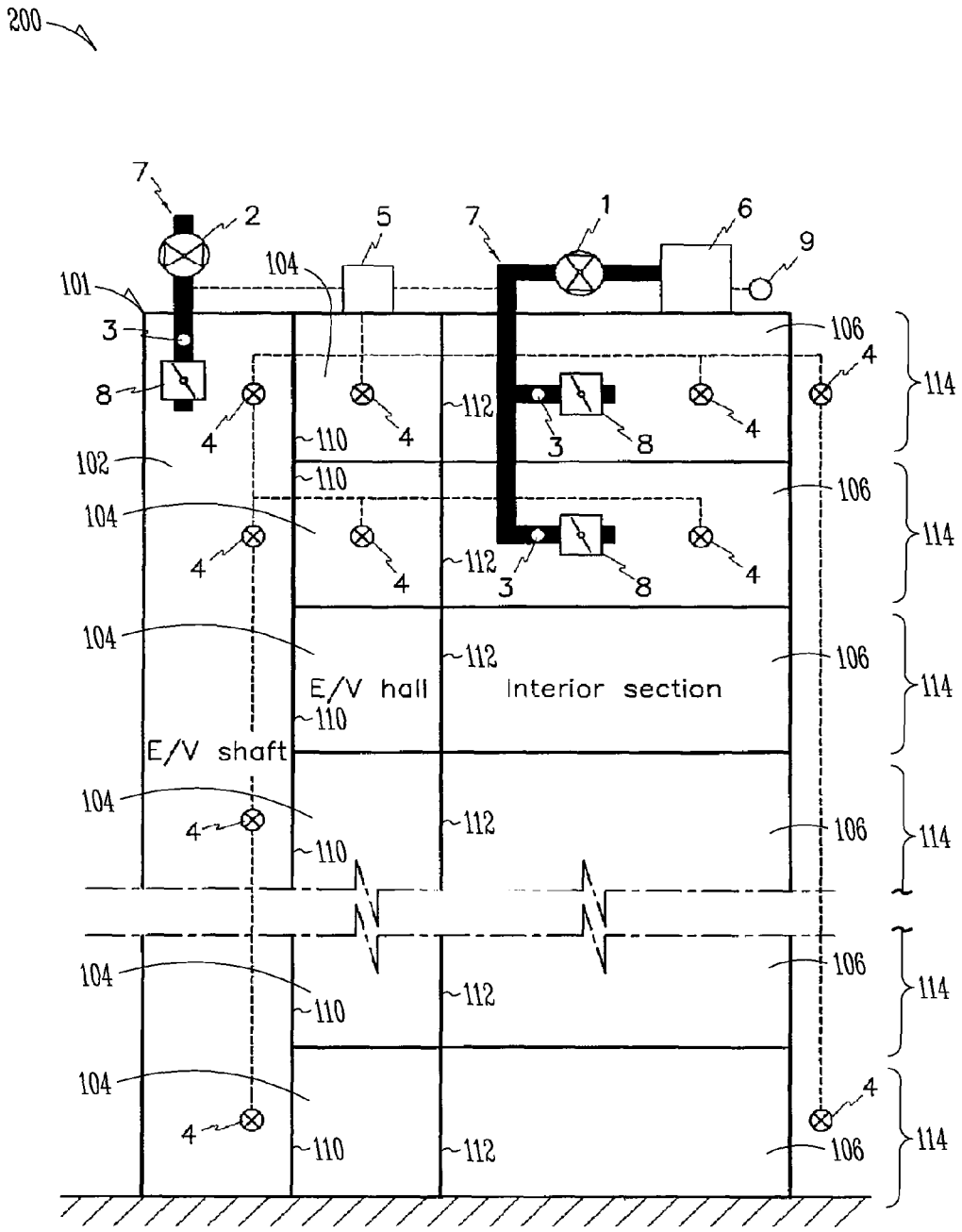
FIG. 2 is a schematic view (200) of an interior pressurizing apparatus for illustrating a method and system for pressurizing an interior office section (106) of a high-rise building (201) according to an exemplary embodiment of the present invention.

FIG. 1 is a schematic view showing distribution of outdoor air and interior vertical pressure and a concept of a pressure control for illustrating a method and system for pressurizing an interior office section of a high-rise building according to an exemplary embodiment of the present invention, and FIG. 2 is a schematic view of an interior pressurizing apparatus for illustrating a method and system for pressurizing an interior office section of a high-rise building according to an exemplary embodiment of the present invention.

<Determination of Sections to be Pressurized>

In the exemplary embodiment of the present invention, an interior section of the high-rise building is set to be pressurized so that pressure transfer (a phenomenon where the pressure that is reduced in the section to be reduced in pressure is transferred to a section that is not reduced in pressure) is induced toward an outer wall, and thus the secondary problems occurring in the interior sections related to the stack effect can be prevented.

<Step 1>

Pressure resistance performance of a dividing door (112) for dividing an elevator hall (104) and an interior section (106) of the building (101) is first checked, and passing wind velocity is set by measuring the passing wind velocity when the elevator door (110) is opened. A pressurizing degree of the interior section of the floor (114) to be pressurized is calculated based on the checked pressure resistance and the passing wind velocity. A studying method and procedure for calculating the pressurizing degree is as follows:

1 The pressure resistance performance is checked by measuring an acting pressure difference condition generated by incomplete closing of the dividing door while varying an indoor air conditioning state (i.e., varying a pressurizing condition and pressure reducing condition by varying the supply and exhaust air volumes) in one floor. Alternatively, the pressure resistance performance may be checked by checking if the incomplete closing of the dividing door in the floors above a neutral zone occurs and measuring the acting pressure difference. Here, the pressure resistance performance of the dividing door means the acting pressure difference condition where no incomplete closing occurs.

② The passing wind velocity when the elevator door is opened is measured in each floor of the building, and an appropriate passing wind velocity is determined considering allowable unpleasant feeling (considering if the enmity of people is incurred or not). At the same time, a pressure difference between an elevator shaft and an elevator hall is measured under a condition where the proper passing wind velocity is generated.

③ Absolute pressure for each dividing section such as the elevator shaft, the elevator hall, and the interior spaces in each floor where the enmity of the people incurs due to the incomplete close of the dividing door and the passing wind velocity when the door is opened is measured, and a pressure apportionment rate of each dividing section is calculated.

④ The absolute pressure of each dividing section and a pressure difference between the pressures apportioned to the dividing sections are calculated considering the calculation pressure apportionment rate and the stack effect (the pressure difference between the outdoor air and shaft) under the design outdoor temperature condition and indoor temperature condition (a maximum indoor/outdoor temperature difference generating condition). The stack effect under the design temperature condition is calculated by checking a location of the neutral zone and a distance from the neutral zone.

⑤ Indoor absolute pressure is calculated under the design temperature condition satisfying the pressure resistance performance of the dividing door and the pressure difference between the elevator shaft and the elevator hall at the level of the appropriate passing wind velocity considering the calculated pressure apportionment rate. Here, the considering of the calculated pressure apportionment rate means that the original pressure apportionment rates for the elevator door and the dividing door dividing the elevator hall and the interior section are readjusted based on the pressure difference between the elevator shaft and the interior section.

In the exemplary embodiment of the present invention, the movement of the neutral zone is prevented by exhaust air volume from the elevator shaft to the outdoor side as much as an amount of the air that is reduced and exhausted from the elevator shaft to the interior section by pressurizing the interior section (see FIG. 1).

The reason for fixing the neutral zone is because, when an air exhaust volume from the elevator shaft to the interior section is reduced by pressurizing the interior section of the floor, the neutral zone moves downward and thus the secondary problems that may occur in the floor where the interior section is not pressurized becomes more serious.

⑥ A degree of pressurization of the interior section is determined from an interior absolution pressure $P_1$ under the design indoor/outdoor temperature conditions calculated in ④ and an interior absolute pressure $P_2$ satisfying the condition calculated in ⑤. That is, the difference between the interior absolution pressure $P_1$ and the interior absolute pressure $P_2$ becomes the degree of pressurization.

<Step 2>

The supply air volume required for the pressurization and the exhaust air volume from the elevator shaft are calculated based on the degree of the pressurization of the interior section, which is determined in Step 1. A studying method and procedure for calculating the supply air volume and exhaust air volume is as follows.

① An air leakage area for the some sections of the building is calculated. The measurement of the air leakage may be more easily preformed when the dividing door for dividing the elevator hall and the interior section is measured considering the dividing scale.

② The air leakage area for the remaining sections is calculated from the air leakage area calculated in ① of Step 2 and the pressure apportionment rate calculated in ③ of Step 1.

③ An amount $Q_1$ of air flowing between the dividing sections of the floors where the problems occurs is checked by performing a simulation with respect to the design indoor/outdoor temperature conditions and the air leakage area condition determined in ① and ② of Step 2.

④ After the amount $Q_1$ of the air passing through the divided sections and a pressure difference $\Delta P_{1_io}$ between the indoor and outdoor sides are applied to the following expression 1, an amount $Q_2$ of the air that is increased when the $\Delta P_{1_io}$ is changed to $\Delta P_{2_io}$ that is increased as much as the degree of the pressurization ($P_2$-$P_1$) determined in ⑥ of Step 1 is calculated in a state where other conditions αA, g, γ of the expression 1 are fixed. Here, the $Q_2$ can be easily calculated using the following Expression 2.

$$Q = 0.36 \times \alpha A \times \sqrt{\frac{2g}{\gamma} \times \Delta P} \quad \text{[Expression 1]}$$

Here, a flow amount of air ($m^3/h$): a flow coefficient (approximately 0.6-0.7): an opening area ($cm^2$): an equal opening area ($cm^2$): acceleration of gravity (≈9.8 $m/s^2$): a specific weight of air ($kgf/m^3$): a pressure difference between the interior sections (mmAq)

$$Q_2 = Q_1 \times \sqrt{\frac{\Delta P_{2_io}}{\Delta P_{1_io}}} \quad \text{[Expression 2]}$$

⑤ After the amount $Q_1$ of the air passing through the divided sections, which checked in ③ of Step 2 and the pressure difference $\Delta P_{1_io}$ between the elevator shaft and the interior section are applied to the expression 1, a flow amount $Q_1$ of the air that is reduced when the $\Delta P_{1_io}$ is changed to $\Delta P_{2_io}$ that is increased as much as the degree of the pressurization ($P_2$-$P_1$) determined in ⑤ of Step 1 is calculated in a state where other conditions αA, g, γ of the Expression 1 are fixed. Here, the $Q_3$ can be easily calculated using the following Expression 2.

$$Q_3 = Q_1 \times \sqrt{\frac{\Delta P_{2_si}}{\Delta P_{1_si}}} \quad \text{[Expression 3]}$$

⑥ Here, $Q_2$-$Q_3$ becomes the supply air volume required for pressurizing the interior sections.

⑦ Here, $Q_1$-$Q_3$ becomes the exhaust air volume from the elevator shaft to the outdoor side.

<Step 3>

The neutral zone is fixed and the interior section is pressurized based on the supply air volume required for pressurizing the interior section and the exhaust air volume from the elevator shaft to the outdoor side, which are determined in Step 2. When pressurizing the interior section, the following factors must be considered.

① Since there may be a certain amount of errors for the supply and exhaust air volumes calculated in ⑥ and ⑦ of Step 2 in accordance with the actual air leakage area distribution, building state, and the like, there is a need to adjust the supply and exhaust air volumes by obtaining a marginal amount of the wind when selecting the air supply and exhaust fans.

② When the interior sections of two or more floors are pressurized, the degree of the pressurization and a pressurizing air volume may be independently set for the respective floors. Alternatively, the degree of the pressurization and the pressurizing air volume are collectively set based on the uppermost floor whose interior sections are pressurized and identically applied to the floors.

③ An outdoor air temperature range required for pressurizing the interior section is set considering a stack effect variation property (pressure variation property) in accordance with the change of the outdoor air temperature condition during winter. Particularly, when the degree of the pressurization and the amount of the pressurizing wind are collectively set as described in ②, the acting pressures of the dividing doors, which are determined by the pressurization of the interior section, differ from each other by the floors, and the outdoor air temperature ranges required for pressurizing the interior sections are independently set.

④ In addition, the degree of the pressurization and the pressurizing air volume with respect to the outdoor temperature condition are set within the outdoor temperature range required for pressurizing the interior sections. The degree of the pressurization and the amount of the pressurizing air volume with respect to the outdoor temperature condition are calculated based on the methods described in Steps 1 and 2.

⑤ The exemplary embodiment of the present invention provides an interior zone pressurizing method and system based on a case where the pressure of the interior section is not varied in accordance with air conditioning using the conventional air conditioning method. When the pressure of the interior section is varied in accordance with the air condition, there is a need to consider an actual affect when the interior section is pressurized when the degree of the pressurization and the supply and exhaust air volumes are set.

<Outline of an Interior Section Pressurizing System for Lessening the Stack Effect Problem>

FIG. 2 shows schematically a system for controlling pressure of an interior section (106) according to an exemplary embodiment of the present invention. The system includes an indoor air supply unit 1, an elevator shaft air exhaust unit 2, supply/exhaust air volume sensors 3 for supplying and exhausting the air, absolute pressure sensors 4 for the interior and exterior sections and the elevator shaft (102), an automatic control unit 5, a supply air temperature control unit 6, a duct unit 7, a damper 8, and an outdoor air temperature sensor 9. The following will describe the operation of the system.

① The air supply unit 1 supplies the air to the indoor section based on the degree of the pressurization and the supply/exhaust air volume that are set in accordance with the above-described interior section pressurizing method of the exemplary embodiment. Typical air supplying and exhaust fans may be used as the air supply unit 1 and the air exhaust unit 2. Therefore, the air supply unit 1 and the air exhaust unit 2 will not be described in detail.

② The supplying amount of the air by the air supply unit 1 and the exhausting amount of the air from the elevator shaft are adjusted by the automatic control unit 5 receiving the signal from the supply/exhaust air volume sensor 3.

③ The degrees of the pressurization and the supply/exhaust air volume that are set in accordance with the pressurizing method of the exemplary embodiment are input to the automatic control unit 5. In the initial operation, the automatic control unit 5 controls the operation of the air supply unit 1 and the air exhaust unit 2 in accordance with information on the outdoor air temperature and the supply/exhaust air volume that are measured by the outdoor air temperature sensor 9.

④ When the indoor section is not pressurized up to the degree of the pressurization by the operation of the air supply unit 1 and the air exhaust unit 2 in accordance with the information on the amount of the wind, the automatic control unit 5 controls the air supply unit 1 and the air exhaust unit 2 in accordance with the information on the degree of the pressurization input to the automatic control unit 5 such that the amount of the wind supplied and exhausted by the air supply and exhaust units 1 and 2 increases. On the other hand, when the indoor section is pressurized above the degree of the pressurization, the automatic control unit 5 controls the air supply unit 1 and the air exhaust unit 2 in accordance with the information on the degree of the pressurization input to the automatic control unit 5 such that the supply/exhaust air volume by the air supply and exhaust units 1 and 2 is reduced.

⑤ It is determined by the automatic control unit 5, which calculates the pressure difference between the interior section and the elevator shaft by receiving a measured valve from the absolute pressure sensor 4 for the indoor section and the elevator shaft, whether the indoor section is pressurized by the preset degree of the pressurization. When the indoor section is pressurized by the preset degree of the pressurization, the operation condition of the air supply unit 1 for the indoor section and the air exhaust unit 2 for the elevator shaft are fixed by the automatic control unit 5.

⑥ The automatic control unit 5 receiving a value measured by the absolute pressure sensor 4 of the elevator shaft calculates the pressure difference between the indoor section of the floor that is not pressurized and the elevator shaft to determine if the neutral zone moves or not by the vertical pressure distribution variation of the building. When it is determined that the neutral zone moves, the automatic control unit 5 controls the air exhaust unit 2 for the elevator shaft such that the amount of the exhaust wind increases or decreases. When the neutral zone is returned to the initial location, the automatic control unit 5 controls the air exhaust unit 2 for the elevator shaft such that the exhaust air volume is fixed.

⑦ The ④, ⑤, and ⑥ are performed in a combination manner, and the increase and decrease amount of the supply and exhaust air volumes are determined in accordance with the following expression 4 representing a ratio between the supply air volume for pressurizing the interior section and the exhaust air volume from the elevator shaft.

[Expression 4]

$$\frac{Q_1 - Q_3}{Q_2 - Q_3} = \frac{1 - \sqrt{\frac{\Delta P_{2-si}}{\Delta P_{1-si}}}}{\sqrt{\frac{\Delta P_{2-io}}{\Delta P_{1-io}}} - \sqrt{\frac{\Delta P_{2-si}}{\Delta P_{1-si}}}}$$

Herein, the $Q_1$ indicates an amount of air flowing between the divided sections before pressurization (including an exterior covering), the $Q_2$ indicates an amount of air flowing through the exterior covering after pressurization, the $Q_3$ indicates an amount of air flowing between the divided sections (excepting for the exterior covering), the $\Delta P_{1_io}$ denotes a pressure difference between the interior section and the exterior section before pressurization, the $\Delta P_{2_io}$ denotes a pressure difference between the interior section and the exterior section after pressurization, the $\Delta P_{1_si}$ indicates a pressure difference between the elevator shaft and the interior section before pressurization, and the $\Delta P_{2_si}$ indicates a pressure difference between the elevator shaft and the interior section after pressurization.

⑧ The air supplied to the interior section by the air supply unit 1 is pre-heated to a preset temperature of the indoor section by the supply air temperature control unit 6. The pre-heat load of the air is adjusted in accordance with the supply air volume information by the supply/exhaust air volume sensor 3 and the outdoor air temperature information by the outdoor temperature sensor 9. A typical air conditioner that is installed in a building or a typical heater that can pre-heat the air may be used as the supply air temperature control unit 6. Therefore, the supply air temperature control unit 6 will not be described in detail.

In addition, when the air conditioner that is pre-installed in the building has a marginal volume with respect to the air volume and pre-heat load, it is possible to utilize the air conditioner.

⑨ The automatic control unit 5 determines whether the system operates and the operation conditions by receiving the measured temperature signal from the outdoor air temperature sensor 9 in accordance with the information on the outdoor air temperature range that is input to the automatic control unit 5, which interior section is required to be pressurized, the information on the degree of the pressurization with respect to the outdoor air temperature condition, and the supply/exhaust air volume. When it is determined that there is no need to operate the system, the duct unit 7 is closed by the damper 8 in accordance with the command of the automatic control unit 5.

(10) Additionally, there is a need to prevent the generation of dewdrops through the heat insulation of the duct unit 7 contacting the air of the external side with respect to the exhaust unit 2 for the elevator shaft.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An interior zone pressurizing method for lessening a stack effect problem in a building, the method comprising:

checking pressure resistance performance of a dividing door, wherein the dividing door divides a floor of a plurality of floors of the building into an elevator hall and an interior section, wherein an elevator door separates the elevator hall from an elevator shaft extending between the plurality of floors, wherein the elevator hall is positioned between the interior section and the elevator shaft;

determining a passing wind velocity by measuring the passing wind velocity between the elevator hall and the interior section of the building on a given one of the plurality of floors when the elevator door is opened;

calculating a pressurizing degree of the interior section of a given one of the floors to be pressurized based on the checked pressure resistance performance and the passing wind velocity;

calculating a supply air volume required for the pressurization and an exhaust air volume from the elevator shaft to an outdoor side based on the degree of the pressurization of the interior section of the given one of the floors; and pressurizing the interior section of the given one of the floors based on the supply air volume required for pressurizing the interior section and the exhaust air volume from the elevator shaft to the outdoor side while fixing a neutral zone.

2. The interior zone pressurizing method of claim 1, wherein, in order to prevent secondary problems, which may be caused by downward movement of the neutral zone and pressurization of only selected floors, from occurring in the floor whose interior section is not pressurized, a same amount of air as the exhaust air volume from the elevator shaft to the interior section is exhausted from the elevator shaft to the outdoor side to fix the neutral zone.

3. An interior zone pressurizing system for lessening a stack effect problem in a building, the system comprising:

an elevator shaft extending vertically within the building between a plurality of floors, at least one elevator hall on one of the plurality of floors separated from the elevator shaft by an elevator door, each elevator hall is positioned adjacent to the elevator shaft between the elevator shaft and an interior section on the corresponding floor of the plurality of floors, a dividing door separating each floor into the interior section and the elevator hall, an indoor air supply unit comprising a duct unit to supply external air to the interior section of a floor to be pressurized in the building;

an elevator shaft exhaust air volume comprising a duct unit to exhaust air from an elevator shaft of a building to an outdoor side of the building;

a supply/exhaust air volume sensor for measuring the supply air volume of the indoor air supply unit and the exhaust air volume of the elevator shaft;

a plurality of absolute pressure sensors that are installed in the elevator shaft, the interior section, and an outdoor side of the building to measure absolute pressures of the elevator shaft, an absolute pressure of the interior section, and an absolute pressure of the outdoor side;

an automatic control unit for pressurizing the interior section up to a preset level by calculating a pressure difference between the interior section of the floor to be pressurized and for controlling operation of the indoor air supply unit and elevator shaft air exhaust unit such that a neutral zone is not moved by calculating a pressure difference between an interior section of a floor not to be pressurized and the elevator shaft using measured values from the supply air volume sensor and the absolute pressure sensors;

a supply air temperature control unit that is installed in the indoor air supply unit to pre-heat the outdoor air supplied to the interior section of the floor to be pressurized;

a damper for preventing the air from flowing through the indoor air supply unit and the elevator shaft air exhaust unit when the system is not being operated; and an outdoor air temperature sensor that is designed to transfer measured data to the automatic control unit, that determines the temperature of the outdoor air to adjust operation conditions of the indoor air supply unit and the elevator shaft air exhaust unit, and that adjusts a pre-heat load of the supply air temperature control unit.

4. The interior zone pressurizing system of claim 3, wherein, in order to prevent the neutral zone from moving by reduction in the exhaust air volume from the elevation shaft to the interior section by pressurization of the interior section, the system is designed to increase or decrease an exhaust air volume from the elevator shaft to the outdoor side by measuring a vertical pressure distribution of the building in accordance with the pressure difference between the interior section of the floor not to be pressurized and the elevator shaft.

5. The interior zone pressurizing system of claim 3, wherein, in order to simultaneously adjust the degree of the pressurization of the interior section and adjust the movement of the neutral zone, the system determines a ratio between the supply air volume of the indoor air supply unit for pressurizing the interior section and the exhaust air volume of the elevator shaft exhaust unit for adjusting the movement of the neutral zone using the following expression:

[Expression]

$$\frac{Q_1 - Q_3}{Q_2 - Q_3} = \frac{1 - \sqrt{\frac{\Delta P_{2-si}}{\Delta P_{1-si}}}}{\sqrt{\frac{\Delta P_{2-io}}{\Delta P_{1-io}}} - \sqrt{\frac{\Delta P_{2-si}}{\Delta P_{1-si}}}}$$

wherein, the $Q_1$ indicates an amount of air flowing between the divided sections before pressurization (including an exterior covering), the $Q_2$ indicates an amount of air flowing through the exterior covering after pressurization, the $Q_3$ indicates an amount of air flowing between the divided sections (excepting for the exterior covering), the $\Delta P_{1_io}$ denotes a pressure difference between the interior section and the exterior section before pressurization, the $\Delta P_{2_io}$ denotes a pressure difference between the interior section and the exterior section after pressurization, the $\Delta P_{1_si}$ indicates a pressure difference between the elevator shaft and the interior section before pressurization, and the $\Delta P_{2_si}$ indicates a pressure difference between the elevator shaft and the interior section after pressurization.

* * * * *